US005603617A

United States Patent [19]

Light

[11] Patent Number: 5,603,617

[45] Date of Patent: Feb. 18, 1997

[54] SPORTS TRAINER

[76] Inventor: James H. Light, 319 Somerset Ave., Sarasota, Fla. 34243

[21] Appl. No.: 918,003

[22] Filed: Jul. 24, 1992

[51] Int. Cl.[6] ..... A63B 69/36

[52] U.S. Cl. ..... 434/252; 434/247; 473/278

[58] Field of Search ..... 434/371, 247–257; 273/35 A, DIG. 28; 473/278

[56] References Cited

U.S. PATENT DOCUMENTS

| | | | |
|---|---|---|---|
| 1,410,811 | 3/1922 | Lewis . | |
| 1,558,762 | 10/1925 | Richter . | |
| 3,110,495 | 11/1963 | Carter | 273/35 |
| 3,353,282 | 11/1967 | Sneed | 434/257 |
| 3,611,591 | 10/1971 | Light | 434/252 |
| 3,915,457 | 10/1975 | Casey | 273/183 |
| 4,015,344 | 4/1977 | Michaels | 434/257 |
| 4,383,687 | 5/1983 | Wolff | 273/35 |
| 4,449,708 | 5/1984 | Humphrey | 273/186 |
| 4,504,055 | 3/1985 | Wells | 273/85 |

*Primary Examiner*—Gene Mancene
*Assistant Examiner*—Jeffrey A. Smith
*Attorney, Agent, or Firm*—Jacobson, Price, Holman & Stern, PLLC

[57] ABSTRACT

A sports trainer by which a user is positioned in front of a full length mirror which reflects the image of the user when performing certain sports activities combined with a television monitor and video cassette player which provides an observable illustration of the same sports activity in the form of a mirror image depicting an optimum of the sports activity involved thereby enabling the user to compare the reflected image in the mirror and the illustrated mirror image in the television monitor in order for the user to closely approach the optimum position and movement illustrated on the television monitor. The disclosure in this application relates to golf but the sports trainer can be used with various types of sports involving positions and movements of individuals and various equipment used in various sports.

3 Claims, 1 Drawing Sheet

SPORTS TRAINER

BACKGROUND OF THE INVENTION

1. Field of the Invention

The present invention generally relates to a training device and more specifically a sports trainer by which a user is positioned in front of a full length mirror which reflects the image of the user when performing certain sports activities combined with a television monitor and video cassette player which provides an observable illustration of the same sports activity in the form of a mirror image depicting an optimum of the sports activity involved thereby enabling the user to compare the reflected image in the mirror and the displayed mirror image in the television monitor in order for the user to closely approach the optimum position and movement displayed on the television monitor. The disclosure in this application relates to golf but the sports trainer can be used with various types of sports involving positions and movements of individuals and various equipment used in various sports as well as in applications for training in the arts and industrial skills.

2. Description of the Prior Art

When an individual decides to become engaged in a particular sport activity, the student player frequently will take lessons from a skilled or professional player in that particular sport. Various training books and training regimens including instructive video cassettes have long been used as training aides. In addition, various types of apparatuses have been provided to assist a student player in proper positioning and proper movement when a sport activity involves holding and moving paraphernalia in a particular pattern for optimum play of the sport. The following U.S. patents disclose training apparatuses of this type.

U.S. Pat. No. 1,410,811

U.S. Pat. No. 1,558,762

U.S. Pat. No. 3,110,495

U.S. Pat. No. 3,915,457

U.S. Pat. No. 4,383,687

U.S. Pat. No. 4,449,708

U.S. Pat. No. 4,504,055

While the above listed patents disclose various apparatuses for training or instructing individuals with respect to proper positioning and movement when engaged in various sports, such as golf, and utilize mirrors to enable a student or trainee to observe their position and movement, the above patents do not disclose the specific arrangement of mirror to reflect the image of the student player or trainee combined with a television monitor closely associated with the mirror which depicts the same reflected image of a skilled or professional player demonstrating optimum positions and movements to which the student player or trainee should aspire.

SUMMARY OF THE INVENTION

An object of the present invention is to provide a sports trainer for teaching a student player or trainee proper positioning, techniques and movements for effectively performing and enjoying various sports activities which includes a mirror to reflect the full length of a student player oriented in facing relation to the mirror to enable the anatomical positioning, orientation of equipment or paraphernalia, the techniques and movements when performing the sports activity to be observed combined with a television monitor oriented in adjacent relation to the mirror which can also be observed by the student player in which the television monitor displays a reflected image of a skilled or professional player demonstrating the optimum positions, techniques and movements when performing the same sports activity.

Another object of the invention is to provide a sports trainer in accordance with the preceding object in which the mirror and associated structure is provided in a mobile stand with the mirror being adjustable and the television monitor positioned immediately below the mirror with the television monitor including a video cassette recorder/player with the optimum positioning, techniques and movements being recorded on a videotape cassette with the structure including means for storing one or more video cassette tapes to display various optimum sport activities.

A further object of the invention is to provide a sports trainer for various sports, such as golf, in which a mat is provided with positioning areas for the student player and positioning areas for certain equipment or paraphernalia with the mat including ball positions and indicating lines to indicate various positions in which the ball may be placed in relation to the student player all of which is observed when the ball is struck by a golf club under the control of a student player to enable the student player to compare the position, techniques and movements that were followed when striking the ball with the optimum position, techniques and movements displayed in the reflected image depicted on the television monitor screen which is immediately adjacent the full length mirror to enable the student trainee and others to observe and compare and make corrections and changes as may be deemed prudent to improve the effectiveness of the student player when actually performing the sports activity.

Another important feature of the invention is the display on the television monitor screen of a reflected image which is the same type of reflected image that the student player observes in the full length mirror thus enabling the same type of reflected images to be quickly and easily compared to enable the student player to make appropriate adjustments in the manner of performing various sports activities.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
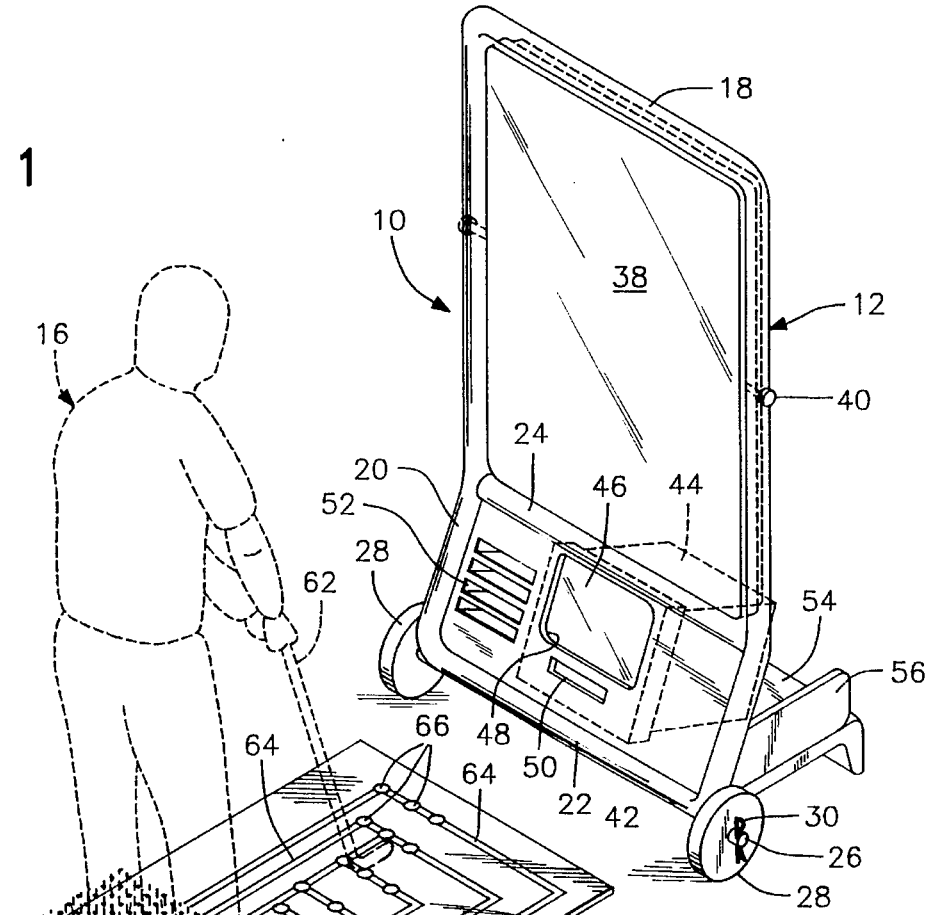
FIG. 1 is a perspective view of the sports trainer of the present invention illustrating its manner of use.
Figure 2:
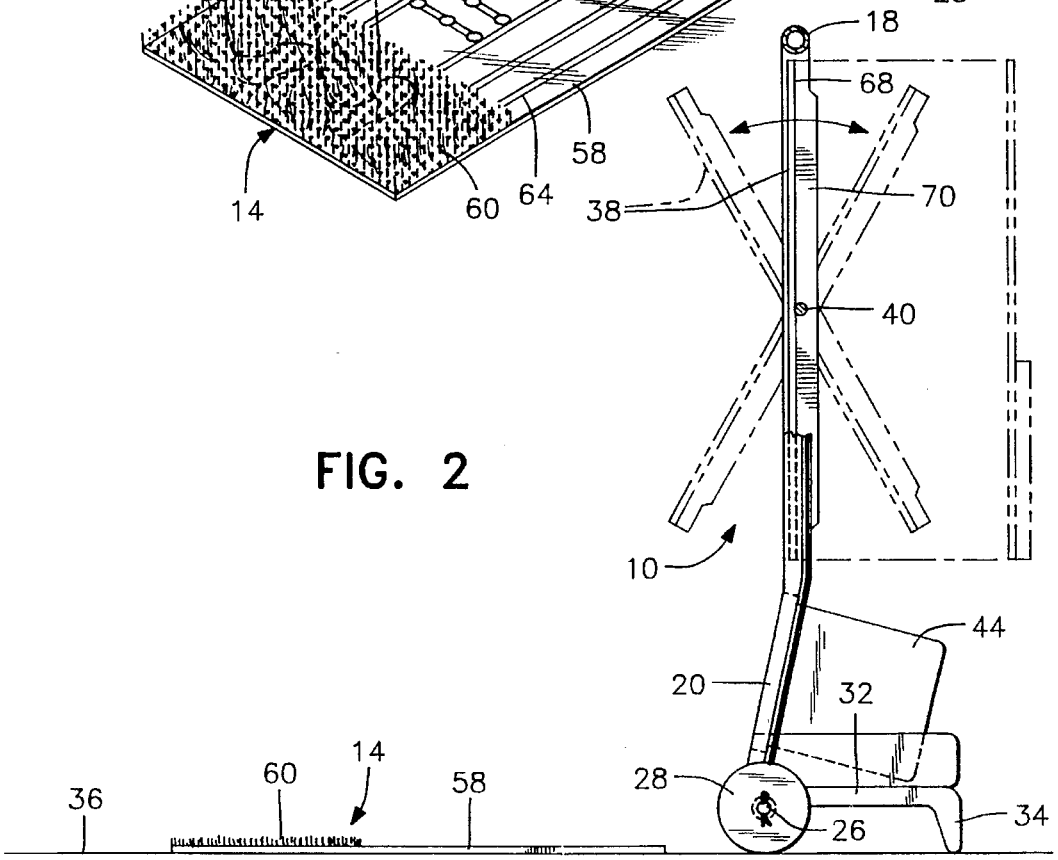
FIG. 2 is a side elevational view, with portions broken away, illustrating the relationship of the various components and the structure of the components forming the present invention.

Referring now specifically to the drawings, the sports trainer of the present invention is generally designated by reference numeral 10 and includes a portable and mobile stand 12 associated with a mat 14 on which a student player or trainee generally designated by reference numeral 16 is positioned when using the sports trainer. While the student player 16 and the mat 14 illustrate schematically a golfer, it is pointed out that this invention can be used with other sports activities in which equipment such as balls, pucks, bats, rackets and the like are used in performing various activities in which initial positioning is important along with techniques and movements.

The stand 12 includes a generally vertically disposed, generally rectangular frame 18 having a forwardly inclined lower portion 20 which includes a horizontal bottom frame member 22 and a horizontal intermediate frame member 24 which separates the forwardly inclined lower portion 20 and the vertical frame 18. The bottom frame member 22 includes projecting axles 26 on which supporting wheels 28 are journaled and retained in position by a removable pin 30 or the like with the two wheels 28 enabling the stand to be easily moved to a desired location by pulling or pushing the stand with the upper end of the frame serving as a handle and the wheels rollingly engaging a supporting surface.

To support the frame 18, the bottom frame member 22 includes generally horizontally disposed lateral extensions 32 having downturned end legs 34 which engage a supporting surface 36 in spaced relation to the wheels 28 thus supporting the frame 18 in an upright position as illustrated in the drawings.

The vertical frame 18 surrounds an enlarged mirror 38 which has its reflective surface facing the mat 14 and the student player 16 and may be in the form of a full length mirror in order for the student player to observe the mat as well as the entire height of the student player. The mirror 38 is adjustable about a horizontal axis adjacent its vertical center by a pair of pivot pins or pivot bolts 40 by which the mirror 38 can be tilted in relation to the frame 18 and, if desired, a frictional structure may be provided on the pins or bolts 40 to secure the mirror in adjusted position which enables only a portion of the player or mat to be observed in the mirror by the player.

The forwardly inclined lower frame portion 20 includes a panel 42 having a TV monitor 44 supported rearwardly thereof with the TV monitor screen 46 being observable through an enlarged opening 48 in the panel 42 with the inclination of the panel being such that the student player can observe the TV monitor screen. The TV monitor includes a built-in or separate video cassette recorder/player having an access opening 50 below the screen 46 together with suitable controls for controlling operation of the TV monitor and video cassette recorder/player so that the images recorded on the videotape cassette inserted into the slot or opening 50 will be displayed and observable on the TV monitor screen. One or both sides of the panel may be provided with storage slots and compartments 52 for storing a plurality of videotape cassettes in order for the information recorded thereon to be displayed and observed on the TV monitor screen. This structure enables a videotape cassette to be played and optimum positions, techniques and movements displayed and observed on the TV monitor screen 46 for observation by the student player. The number and content of the videotape cassettes available can be varied depending upon the sports activity to be practiced, the level of skill of the student player and the dedication of the student player to improve sports activities.

The stand includes a deck 54 which interconnects the members 32 and is integral therewith and supports the lower corner of the inclined TV monitor and video cassette recorder/player. Side members 56 are provided at each edge of the deck or platform 54 which enables items to be positioned and retained when the stand is being rolled to a position or rolled to a storage site.

The mat 14 is a relatively thin flexible panel 58 which may be constructed of plastic material or the like and the outer end portion of the mat 58 is provided with artificial turf 60 which simulates a grass area and indicates an area on which the student player 16 stands upon while addressing a golf ball and positioning a golf club 62. The upper surface of the mat 58 is provided with a plurality of indicator lines 64 including longitudinal and transverse end lines with spot indicators 66 on which golf balls may be placed to be struck by the golf club. As illustrated, when the student player 16 takes up a position as illustrated in FIG. 1, the initial position can be observed by the student player as well as subsequent movements and techniques involved when the student player strikes the golf ball at the different positions of the golf ball. Thus, the student player observes a reflected image of the position, techniques and movements throughout the golf swing and striking of the ball by the student player. The TV monitor, at the same time, displays the positioning, techniques and movements in the form of the same reflected image with the reflected image in the TV monitor screen displaying optimum positions, techniques and movements of a highly skilled player or professional player in order for the student player 16 to compare optimum conditions with the reflected image of the student player thus enabling the student player to modify the initial position, techniques and movements to more nearly approximate the desired position, techniques and movements as displayed on the TV monitor screen.

As the student player faces the mirror 38, the reflected image as observed by the student player is the image of the student player. The image of the skilled player, professional player or instructor displayed on the TV monitor screen as the videotape cassette is playing is also a reflected image of the skilled player, professional player or instructor which enables the student player to compare the reflected images in order that the student player may alter initial positioning, techniques and movements to more nearly approximate the optimum positions, techniques and movements as demonstrated by the reflected image appearing on the TV monitor screen. One of the essential features of the invention is the filming of the skilled player, professional player or instructor as a reflected image in order that the student player's image and that of the skilled player, professional player or instructor is similar thereby enabling the student player to imitate the exact movements of the instructor as the instructor guides the student through each motion audibly as well as visually. The mat 14 provides instructions to the student player with respect to stance when addressing the ball, ball position in relation to the student player and hitting techniques to provide even further enhancement of the training and capabilities of the student player.

The mirror frame 18 may be provided with a backing panel 68 having a rearwardly offset portion 70 with the upper end thereof providing a slot-like opening so that various materials, visual aids, books, paper and similar relatively thin material may be stored inwardly of the backing panel which may be a vacuum formed panel mounted on the reverse of the mirror by attachment to the peripheral aluminum tubing frame 18.

The stand and frame may be constructed of aluminum tubing or the like thus rendering the entire device relatively lightweight in construction and easy rolled to a site of use where student players would practice their golf swing or other sports activities in order that the student player may become more proficient in performing various sports activities thus enjoying the sports activities due to their increased proficiency and performance.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A sports trainer to enable a student player to practice and become more proficient in performing various sports activities comprising a supporting stand including a generally upright frame, a reflective mirror supported in said frame, a mat supported in front of the mirror, said mat including a delineated area on which a student player assumes a position for observing the reflected image of the student player in the mirror to enable the student player to review and analyze position, techniques and movements when performing a particular sports activity and means displaying optimum position, techniques and movements of a player performing the same sports activity and displaying the optimum position, techniques and movement as a reflected image thereby enabling the student player to observe the displayed optimum reflected image in the mirror and the reflected image for comparison purposes thereby enabling the student player to attain the same position, techniques and movements as displayed in the optimum reflected image, said means displaying optimum reflected images including a television monitor with screen, a video cassette player to play a video cassette tape, and means supporting the television monitor screen in a position adjacent said mirror, said TV monitor screen being positioned on said stand immediately below a center portion of a bottom edge of the mirror to enable the student player to easily observe and compare the reflected image in the mirror and the optimum reflected image on the television monitor screen, said frame including a substantially vertical portion and a lower portion inclined toward said mat, said TV monitor screen being mounted in the inclined portion of the frame in an upwardly, inclined facing relation to facilitate observation by the student player, and supporting wheels and laterally extending, spaced supporting legs on a lower end of the stand to support the stand, frame, mirror and TV monitor in a stable upright manner and enabling these components to be easily moved to a site of use, said mirror being mounted in said frame for pivotal movement about a transverse, generally centrally disposed horizontal axis to enable the mirror to be tilted to provide the student player with a substantially full length reflected image.

2. The sports trainer as defined in claim 1 wherein said mat includes indicia indicating initial positioning of an article of sports equipment to enable a student player to perform certain sports activities in which equipment to be manipulated will be in different initial positions.

3. The sports trainer as defined in claim 2 wherein the indicia on the mat indicates positions of a golf ball to enable a student player to utilize a golf club and observe the reflected image of the student player and the optimum reflected image during various positions, techniques and movements when striking a golf ball.

* * * * *